US008608014B2

(12) United States Patent
Mueller et al.

(10) Patent No.: US 8,608,014 B2
(45) Date of Patent: Dec. 17, 2013

(54) CYLINDRICAL PRESSURE VESSEL HAVING A DEFINED LEAKAGE PATH

(75) Inventors: Carsten Mueller, Stuhr (DE); Mark James Fahey, Mosgiel (NZ)

(73) Assignee: Parker Hannifin Manufacturing Germany GmbH & Co. KG, Bielefeld (DE)

( * ) Notice: Subject to any disclaimer, the term of this patent is extended or adjusted under 35 U.S.C. 154(b) by 0 days.

(21) Appl. No.: 13/452,010

(22) Filed: Apr. 20, 2012

(65) Prior Publication Data

US 2012/0267377 A1 Oct. 25, 2012

(30) Foreign Application Priority Data

Apr. 20, 2011 (DE) ..... 10 2011 018 207

(51) Int. Cl.
*F17C 1/02* (2006.01)

(52) U.S. Cl.
USPC ..... 220/586; 220/585; 220/600; 220/721

(58) Field of Classification Search
USPC ..... 220/586, 585, 581, 587, 367.1, 374, 220/89.1, 227, 203.1, 600, 721; 206/0.6; 165/81, 58; 138/30, 31, 109; 92/50
See application file for complete search history.

(56) References Cited

U.S. PATENT DOCUMENTS

| | | | | |
|---|---|---|---|---|
| 3,815,773 | A * | 6/1974 | Duvall et al. | 220/590 |
| 4,171,832 | A * | 10/1979 | Metcalfe | 285/41 |
| 4,643,249 | A * | 2/1987 | Grawey | 165/159 |
| 4,723,441 | A * | 2/1988 | Sweeney | 73/40.5 R |
| 6,027,319 | A * | 2/2000 | Winefordner et al. | 417/440 |
| 7,108,016 | B2 * | 9/2006 | Moskalik et al. | 138/31 |
| 7,191,672 | B2 * | 3/2007 | Ringgenberg et al. | 73/864.61 |
| 7,225,860 | B2 * | 6/2007 | Baginski et al. | 165/10 |

* cited by examiner

*Primary Examiner* — Andrew Perreault
*Assistant Examiner* — James M Van Buskirk
(74) *Attorney, Agent, or Firm* — Renner, Otto, Boisselle & Sklar, LLP

(57) ABSTRACT

Cylindrical pressure vessel with an internal body enclosed by an external body, with a cylindrical section closed by end caps and with the internal body and external body kept separate from each other to avoid a transfer of shear forces, wherein at least one end cap is connected only with the external body and contacts, with an overlap section intruding into the internal body, the inside surface of the internal body, with a seal arranged in the overlap section that contacts an interior circumferential surface of the internal body, and with at least one recess serving as a defined leakage path in case of an expansion of the external body relative to the internal body being arranged on the side of the seal facing away from the interior chamber, in the interior circumferential surface of the internal body that encloses the overlap section of the end cap.

10 Claims, 3 Drawing Sheets

CYLINDRICAL PRESSURE VESSEL HAVING A DEFINED LEAKAGE PATH

Figure 1:
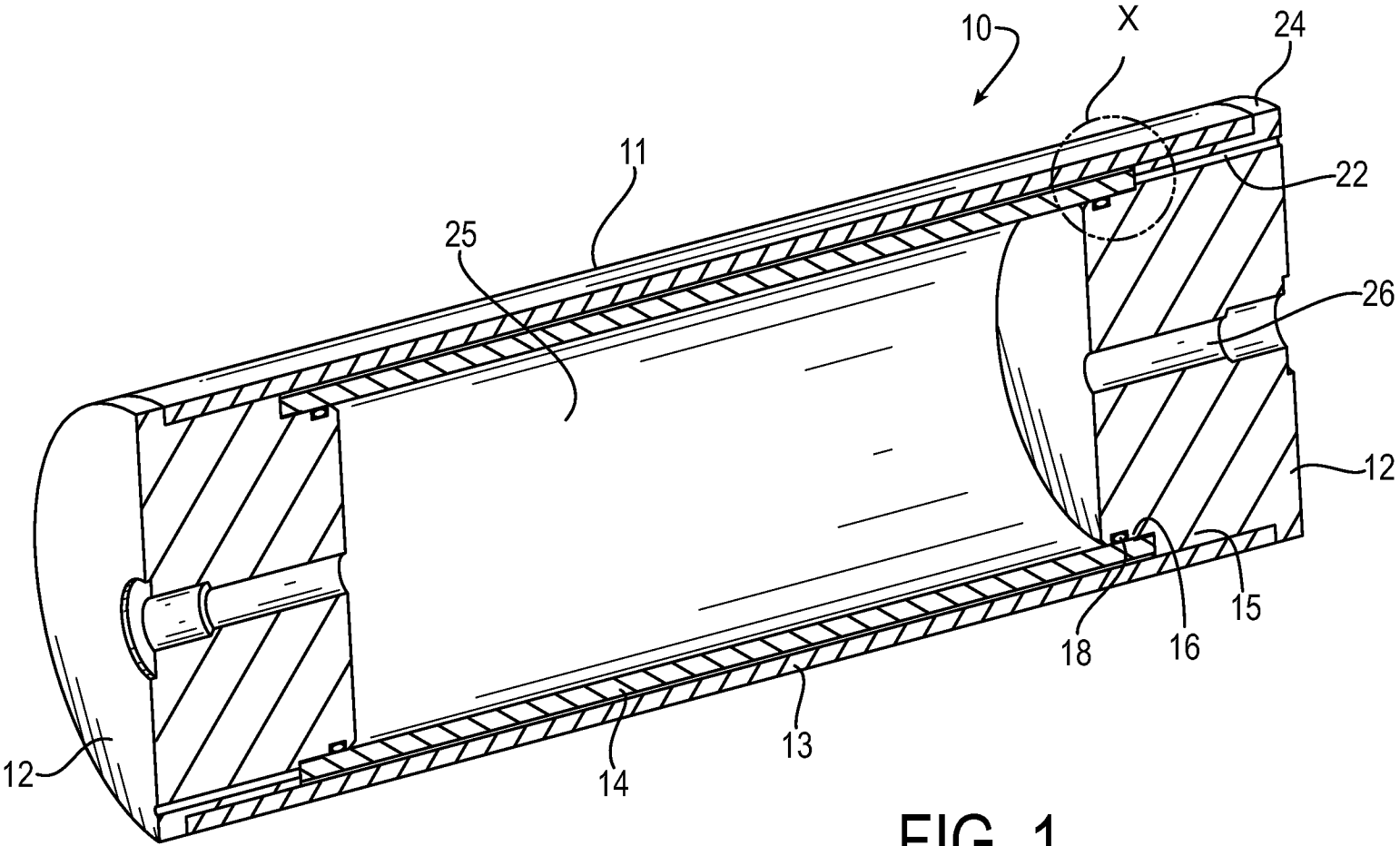

The invention relates to a cylindrical pressure vessel, specifically for applications in hydraulics, made of a fiber-reinforced synthetic material based on resin-impregnated fibers, with an internal body and an external body enclosing the same, with the cylindrical section of the pressure vessel being closed off by means of end caps at its two face sides, and with the internal body and the external body being kept separate from each other in order to avoid a transfer of shear forces.

A cylindrical pressure vessel constructed in accordance with the type characteristics is known from U.S. Pat. No. 3,508,677 A. The basic structure of the pressure vessel consists of an internal body and an external body both consisting of fiber-reinforced synthetic material, with the fibers being aligned differently in the internal body and the external body. Between the internal body and the external body, a sliding plane is provided so that the layers of the structure of the pressure vessel that are located on the inside and the outside of this sliding plane are able to expand or contract independently of each other. In the known pressure vessel, the end caps attached axially to the cylindrical center section are integral components of the multi-layer structure of the vessel.

In pressure vessels of this type, the problem of stress caused by an excessive internal pressure in the vessel may occur which, depending on the strength characteristics of the individual materials used for the production of the pressure vessel, may cause the pressure vessel to burst. In order to avoid a bursting of the pressure vessel and the possible ensuing uncontrollable damage it is known to create a leakage path that becomes effective in case of a pre-settable overpressure in the pressure vessel so that a pressure relief of the pressure vessel can take place and a bursting of the pressure vessel is prevented.

The invention therefore addresses the problem of creating, in a cylindrical pressure vessel constructed in accordance with the type characteristics, such a leakage path that becomes effective only when an overpressure occurs.

The solution of this problem, including advantageous embodiments and developments of the invention, is found in the content of the patent claims following this specification.

The basic idea of the invention provides for at least one end cap to be connected only to the external body and to contact the inside of the internal body with an overlap section intruding into the internal body, with a seal contacting an inner circumferential surface of the internal body being arranged in the overlap section, and with at least one recess—as a defined leakage path in case of an expansion of the external body relative to the internal body—being arranged, on that side of the seal that faces away from the interior chamber of the cylindrical pressure vessel, in the inner circumferential surface of the internal body that encloses the overlap section of the end cap.

Since, according to the invention, at least one end cap is only connected with the external body, only an axial expansion of the external container will occur in case of a pressure load in the interior of the pressure vessel due to the axial pressure component acting on the end caps while the axial extension of the internal container is not influenced, and therefore remains constant. In order for this relative movement of the external body in relation to the internal body not to cause leaks when it occurs below a critical pressure, the end cap connected to the external body is sealed from the internal body, with said seal remaining effective over the length of a certain axial expansion path of the external body in relation to the internal body. Only when, due to a high internal pressure in the pressure vessel that nevertheless remains below the bursting limit, this expansion path of the external body has become so large that the recess arranged in the internal body bridges the seal arranged at the overlap section of the end cap relative to the internal body, thereby providing a leakage path, is the pressure from the inner chamber of the inner container able to vent to the outside, thereby protecting the pressure vessel against bursting.

According to any one embodiment of the invention, the recess is arranged at an axial distance from the seal. This ensures that in the event of an axial expansion of the external body already starting at lower pressures, the effectiveness of the seal between the end cap firmly connected to the external body is maintained because the recess formed on the internal body does not yet reach the seal area.

According to one embodiment of the invention, the recess is implemented as a longitudinal groove that may be designed to have a flat-conical shape.

Regarding the provision of a pressure relief path, the invention provides for the recess to extend to the end of the internal body.

In case of an existing overpressure, in order to vent the medium exiting from the interior chamber of the pressure vessel via the leakage path towards the outside of the pressure vessel, one embodiment of the invention may provide for a pressure relief channel to be arranged in the end cap that extends to the outside of the end cap so that the medium flowing through the leakage path formed by the recess is vented to the outside of the pressure vessel via the pressure relief channel. As an alternative, a gap may be arranged as pressure relief path between the external body and the end cap inserted into it.

Figure 2:
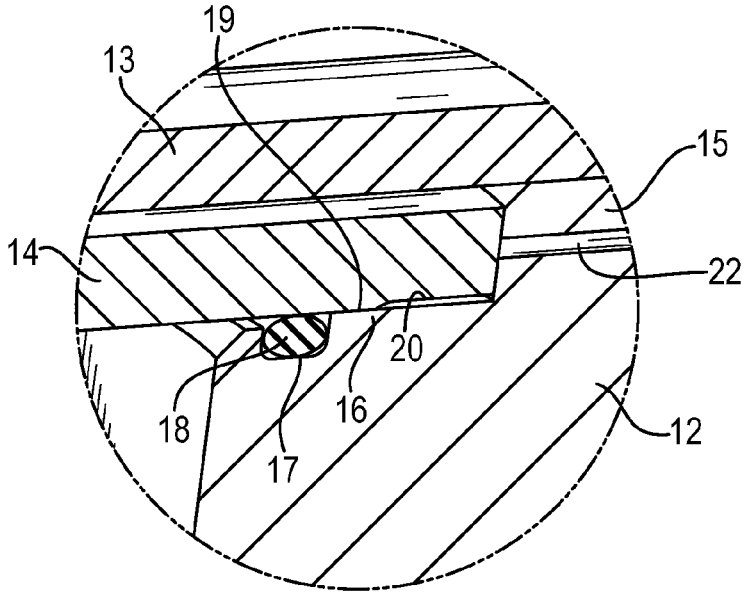
Figure 3A:
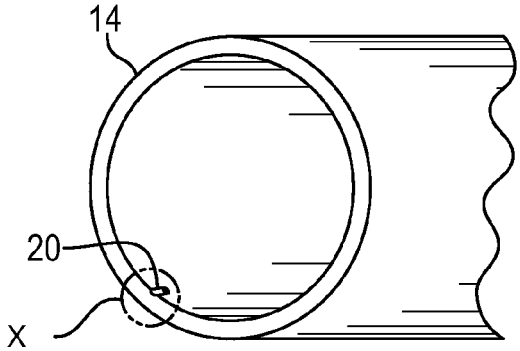
Figure 3B:
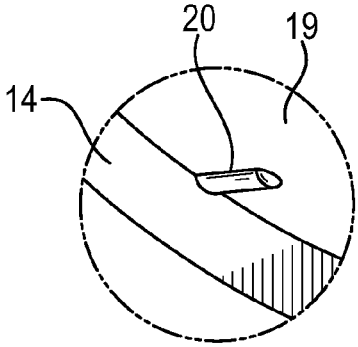
Figure 4:
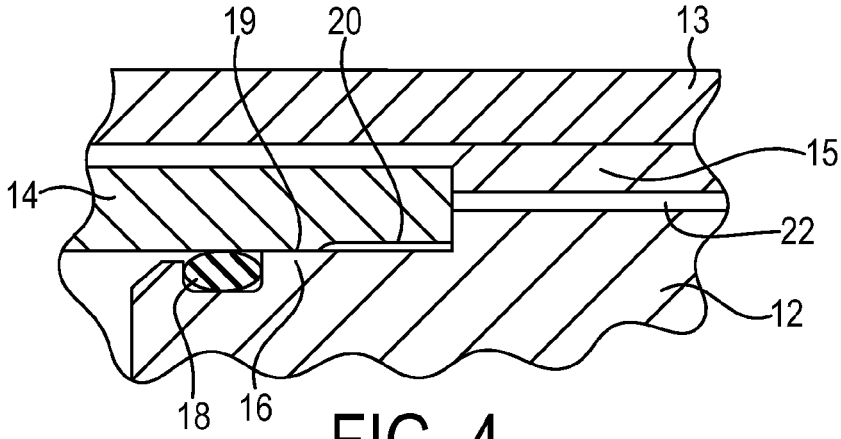
Figure 5:
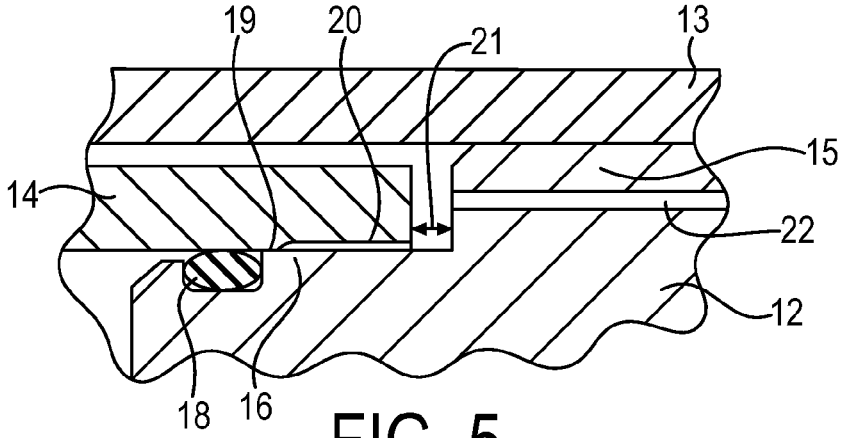
Figure 6:
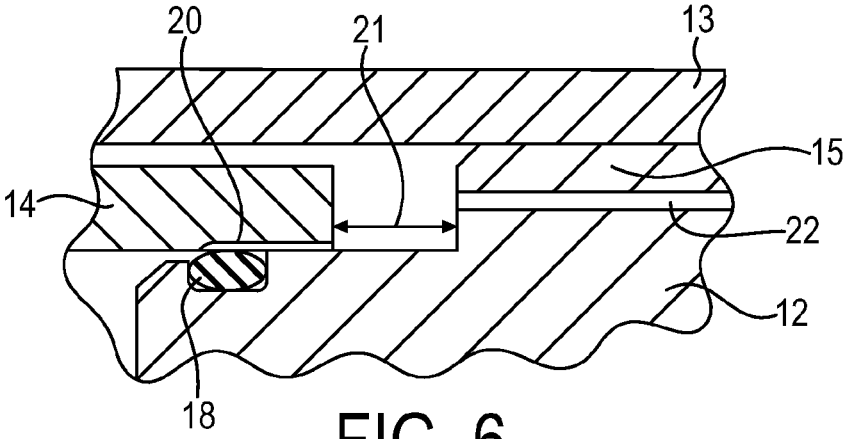

The drawing shows an embodiment of the invention that is described below:

FIG. 1 shows a sectional view of a cylindrical pressure vessel,

FIG. 2 shows an enlarged view of the detail "X" from FIG. 1 with the provided leakage path, FIG. 3*a* shows an individual view of the internal body of the pressure vessel with the recess arranged on it, FIG. 3*b* shows an enlarged view of the detail "X" from FIG. 3*a*, FIG. 4 shows a detail view of the pressure vessel according to FIG. 2 without the pressure vessel being subjected to a pressure load, FIG. 5 shows the detail view according to FIG. 4 in case of a pressure load that is lower than the pressure that would activate the leakage path, FIG. 6 shows the detail view according to FIG. 4 in case of a pressure load that is higher than the pressure that would activate the leakage path.

The pressure vessel 10 shown in FIG. 1 has a cylindrical section 11 both ends of which are each closed off by one end cap 12. This forms an interior chamber 25 in the pressure vessel; in the end caps 12, connecting channels 26 are provided through which the pressure vessel 10 can be filled or emptied.

In detail, the cylindrical section 11 of the pressure vessel 10 consists of an internal body 14 that encloses the interior chamber 25 and an external body 13 that encloses the internal body 14 on the outside. The internal body 14 and the external body 13 each consist of a fiber-reinforced synthetic material based on resin-impregnated fibers. The external body 13 and the internal body 14 are arranged separate from each other, with an intermediate layer for preventing the transfer of shear forces being arranged between the internal body 14 and the external body 13 in the embodiment shown here. The construction of such a body is described in detail in WO 2010/124815 A1, for example.

In the embodiment shown here, the two end caps 12 are of identical design and are consequently connected with the cylindrical section 11 of the pressure vessel 10 in the same way. Specifically, each of the end caps 12 contacts with an outer flange 24 the face side of the external body 13, as a component of the cylindrical section 11 of the pressure vessel, and initially enters with a stepped section 15 the interior of the external body 13. The internal body 14 arranged inside the external body 13 has a shorter axial extension than the external body 13 so that, in the initial state, the stepped section 15 of the end cap 12 intruding into the external body 13 contacts with its face side the associated face side of the internal body 14. The stepped section 15 of the end cap 12 is followed by an overlap section 16 that intrudes further into the internal body 14, with the overlap section 16 of the end cap 12 contacting the interior circumferential surface 19 of the internal body 14. In the front section of the overlap section 16 that faces the interior chamber 25, a groove 17 containing a seal 18 is provided, with the seal 18 contacting the interior circumferential surface 19 of the internal body 14, thereby sealing the interior chamber 25 in the internal body 14 against the outside.

Each end cap 12 is connected firmly exclusively with the external body 13 and is therefore able to shift with its overlap section 16 relative to the internal body 14.

In a section of the overlap section 16 of the end cap 12 that is located on the side of the seal 18 that faces away from the interior chamber 25, at least one recess 20 is arranged in the interior circumferential surface 19 of the internal body 14 that starts at a distance from the seal 18 and extends to the axial end of the internal body 14 when the pressure vessel 10 is not subjected to a pressure load. As the FIGS. 3*a* and 3*b* show, the recess 20 has a flat-conical shape.

If necessary, it is also possible to arrange several recesses (not shown) over the circumference of the internal body 14.

FIGS. 4 to 6 show the function of the arrangement of the end caps 12 according to the invention on the pressure vessel 10 regarding the creation of a leakage path.

As FIG. 4 shows, the seal 18 arranged in the overlap section 16 of the end cap 12 seals the interior chamber 25 of the pressure vessel 10 against the interior circumferential surface 19 of the internal body 14 so that, in the event of rising pressure in the interior chamber 25 of the pressure vessel 10, no medium is able to flow out between the end cap 12 and the internal body 14.

When the pressure in the interior chamber 25 of the pressure vessel 10 rises, the load imposed on the end caps 12 leads to a lengthening of the external body 13 relative to the internal body 14. Since each of the end caps is firmly attached to the external body 13, the end caps 12 move along with the external body 13, with the result that the overlap section 16 of each end cap 12 shifts outward relative to the internal body 14. This condition is shown in FIG. 5, where the pressure existing in the interior chamber 25 has not yet caused such a lengthening of the external body 13 that the seal 18 arranged in the overlap section 16 of the end cap 12 would have reached the recess 20 formed in the internal body 14. Despite the higher pressure, the interior chamber 25 of the pressure vessel 10 is still sealed, according to the view shown in FIG. 5.

FIG. 6 then shows the condition in which the pressure existing inside the interior chamber 25 of the pressure vessel 10 has reached a critical level that, however, is still below the level that would cause the pressure vessel to burst. When this critical pressure is reached, the pressure relief of the interior chamber 25 is initiated. This pressure relief takes place as follows: with a further axial extension of the external body 13 with the end cap 12 attached to it, the seal 18 arranged on the overlap section 16 of the end cap 12 reaches the area of the recess 20 arranged in the interior circumferential surface 19 of the internal body 14, so that the sealing effect of the seal 18 ceases and the medium from the interior chamber 25 of the pressure vessel 10 is able to flow out via the recess 20 past the seal 18.

In order to guide the exiting medium to the outside of the pressure vessel 10, an axially extending pressure relief channel 22 is arranged in the end cap 12 in the embodiment shown here, said channel starting at the face side of the stepped section 15 of the end cap 12 that contacts the face side of the internal body 14. When the end cap 12 shifts relative to the internal body 14, a separation 21 is created between the face sides of the internal body 14 and the stepped section 15 of the end cap 12, into which separation the recess 20 formed on the internal body 14 will then open so that the medium flowing past the seal 18 is able to vent to the outside via the space created by the separation 21 and the pressure relief channel 22.

In an advantageous manner, when the pressure drops in the interior chamber 25 of the pressure vessel 10, the external body 13 will contract again, this process having the effect that the seal 18 will move out of the effective zone of the recess 20 again and will once again contact the interior circumferential surface 19 of the internal body 14, thereby sealing once again the interior chamber 25 of the pressure vessel 10.

The characteristics of the subject of these documents, as disclosed in the above description, the patent claims, the abstract, and the drawing can be essential individually or in random combinations of several for the implementation of the invention in its various embodiments.

The invention claimed is:

1. A cylindrical pressure vessel comprising an internal body defining an interior chamber of the pressure vessel, an external body enclosing the internal body and separate from the internal body in order to avoid a transfer of shear forces, first and second end caps closing respective adjacent axial ends of the internal and external bodies, wherein the first end cap is fixedly attached to the external body and has an overlap section intruding into the internal body, the overlap section being free to shift axially relative to the internal body when pressure in the pressure vessel causes axial expansion of the external body, a seal arranged in the overlap section of the first end cap that contacts the interior circumferential surface of the internal body, the seal being retained in the overlap section for movement with the overlap section when pressure in the pressure vessel causes axial expansion of the external body and axial outward movement of the overlap section relative to the internal body, and at least one recess in an interior surface of the internal body that encloses the overlap section of the first end cap, the recess being located on a side of the seal that faces away from the interior chamber of the pressure vessel so that upon axial expansion of the external body, axial movement of the overlap section relative to the internal body causes the seal to move past an inner axial end of the recess to define a leakage path for fluid contained within the interior chamber of the pressure vessel.

2. The cylindrical pressure vessel according to claim 1, wherein the recess is arranged at an axial distance from the seal when the pressure vessel is unpressurized.

3. The cylindrical pressure vessel according to claim 1, wherein the recess is implemented as a longitudinal groove.

4. The cylindrical pressure vessel according to claim 1, wherein the recess has a flat-conical shape.

5. The cylindrical pressure vessel according to claim 1, wherein the recess extends to the end of the internal body.

6. The cylindrical pressure vessel according to claim 1, wherein the recess fluidly communicates with a pressure relief channel in the first end cap, which pressure relief channel extends to the outside of the first end cap.

7. The cylindrical pressure vessel according to claim 1, wherein a gap serving as pressure relief channel is arranged between the external body and the first end cap.

8. The cylindrical pressure vessel of claim 1, wherein the internal and external bodies are made of fiber-reinforced synthetic material based on resin-impregnated fibers.

9. The cylindrical pressure vessel of claim 1, wherein the second end cap is fixedly attached to the external body.

10. The cylindrical pressure vessel of claim 9, wherein the second end cap is fixedly attached to the internal body.

* * * * *